United States Patent [19]

Nichols et al.

[11] Patent Number: 5,032,299

[45] **Date of Patent: * Jul. 16, 1991**

[54] MAGNESIUM OVERBASING PROCESS

[75] Inventors: Willis P. Nichols, Cleveland; Jack L. Karn, Richmond Heights, both of Ohio

[73] Assignee: The Lubrizol Corporation, Wickliffe, Ohio

[ * ] Notice: The portion of the term of this patent subsequent to Oct. 4, 2005 has been disclaimed.

[21] Appl. No.: 383,466

[22] Filed: Jul. 20, 1989

Related U.S. Application Data

[63] Continuation of Ser. No. 209,250, Jun. 20, 1988, abandoned, which is a continuation of Ser. No. 80,286, Jul. 30, 1987 Pat. No. 4,775,490.

[51] Int. Cl.[5] ..... C10M 159/24

[52] U.S. Cl. ..... 252/33; 252/18; 252/25; 252/39

[58] Field of Search ..... 252/39, 33, 25, 18

[56] References Cited

U.S. PATENT DOCUMENTS

| | | | |
|---|---|---|---|
| 2,616,911 | 11/1952 | Asseff et al. . | |
| 2,616,924 | 11/1952 | Asseff et al. . | |
| 2,695,910 | 11/1954 | Asseff et al. . | |
| 2,761,845 | 9/1956 | Rogers et al. . | |
| 2,856,359 | 10/1958 | Schlicht . | |
| 3,242,079 | 3/1966 | McMillen . | |
| 3,242,080 | 3/1966 | Wiley et al. . | |
| 3,372,114 | 3/1968 | Rense . | |
| 3,377,283 | 4/1968 | McMillen . | |
| 3,422,013 | 1/1969 | Scher . | |
| 3,544,463 | 12/1970 | Kroft . | |
| 3,615,290 | 10/1971 | Nixon | 44/51 |
| 3,629,109 | 12/1971 | Gergel et al. . | |
| 3,671,430 | 6/1972 | Corringer . | |
| 3,793,201 | 2/1974 | Karn . | |
| 3,827,979 | 8/1974 | Piotrowski . | |
| 3,878,116 | 4/1975 | Rueckert . | |
| 3,896,037 | 7/1975 | Dickey . | |
| 4,057,504 | 11/1977 | Shiga et al. . | |
| 4,129,508 | 12/1978 | Friihauf | 252/33 |
| 4,192,758 | 3/1980 | Dickey . | |
| 4,209,471 | 6/1980 | Dube et al. | 260/990 |
| 4,260,500 | 4/1981 | Forsberg . | |
| 4,552,677 | 11/1985 | Hopkins | 252/33.6 |
| 4,627,928 | 12/1986 | Karn | 252/18 |
| 4,744,921 | 5/1988 | Liston . | |
| 4,775,490 | 10/1988 | Nichols et al. | 252/39 |

FOREIGN PATENT DOCUMENTS

| | | |
|---|---|---|
| 1142373 | 5/1966 | United Kingdom . |
| 1200922 | 8/1970 | United Kingdom . |
| 1570909 | 7/1980 | United Kingdom . |
| 1570909 | 7/1980 | United Kingdom . |
| 2037310 | 7/1980 | United Kingdom . |
| 2123021 | 1/1984 | United Kingdom . |

OTHER PUBLICATIONS

PCT International Publication No. WO80/01806.

*Primary Examiner*—Jacqueline V. Howard
*Attorney, Agent, or Firm*—Forrest L. Collins; Frederick D. Hunter; Robert A. Franks

[57] ABSTRACT

A process is disclosed for overbasing a substrate comprising mixing a composition comprising said substrate, water, a phenol containing up to three aliphatic carbon atoms, a source of magnesium and a carbonating agent, under reaction conditions to form a magnesium overbased substrate, said water being retained in said composition throughout the overbasing reaction, the weight ratio of the water to magnesium being about 10:1 to about 1:5. A magnesium overbased substrate made by the foregoing process is disclosed. Concentrates and lubricating compositions containing the foregoing magnesium overbased substrate are also disclosed.

22 Claims, No Drawings

MAGNESIUM OVERBASING PROCESS

This is a continuation of co-pending application Ser. No. 07/209,250 filed on June 20, 1988 now abandoned which in turn is a continuation of Ser. No. 07/080,286 filed on July 30, 1987 now Pat. No. 4,775,490.

BACKGROUND OF THE INVENTION

1. Field of the Invention

This invention relates to overbasing of magnesium compounds which may be utilized in lubricants and rust preventive compositions 2. Description of the Art It is known from U.S. Pat. No. 3,629,109 issued Dec. 21, 1971 to Gergel, Karn and King that lower alkanols may be utilized as copromoters with water to overbase a substrate with a source of magnesium. Asseff et al in U.S. Pat. No. 2,616,911 issued Nov. 4, 1952 describes a process for overbasing an alkaline earth material in the presence of an alkylphenol. In particular, Asseff discloses the use of para-tertiarybutyl phenol. Under the conditions of Asseff, it is disclosed that the water present (from the neutralization during overbasing and any added water) is substantially removed during the overbasing operations.

U.S. Pat. No. 2,695,910 issued Nov. 30, 1954 to Asseff et al describes the production of superbased salts prepared by treating an organic salt complex with a material which possesses acid characteristics under the process conditions, and then combining the treated organic salt complex with an inorganic metal compound with or without water and with or without a promoter present and then substantially removing any remaining water. Among the promoters of Asseff which are stated to be possible materials which may be included during processing are phenol and various alkylated phenols.

Asseff et al in U.S. Pat. No. 2,626,294 issued Nov. 4, 1982 discusses a method of obtaining a higher metal ratio when overbasing alkaline earth materials. The examples of this Asseff patent describe being overbased to a metal ratio of less than 6. As defined, the metal ratio is the ratio of the number of equivalents of the metal to the number of equivalents of the substrate. This Asseff patent states that phenolic compounds may be utilized and defines such materials as being organic compounds having a hydroxy group directly attached to the carbon atom of a benzenoid ring.

Schlicht in U.S. Pat. No. 2,856,359 issued Oct. 14, 1958 describes the production of oil-soluble superbasic sulfonates of alkaline earth metal salts. Schlicht describes promoters for the overbasing reaction including aromatic carboxylic acids, lower molecular weight sulfonic acids, cresols, xylenols, catechols or 3,242,080 issued Mar. 22, 1966 describes hyperbasic sulfonate compositions of alkaline earth metals. Wiley describes the use of polar organic materials such as saturated aliphatic hydrocarbon alcohols containing from one to five hydroxy groups, alkanones, fatty acids, primary alkyl amines, aryl substituted and alkaryl substituted alkanols, phenol, alkylated phenols, saccharides, carbohydrates, animal and vegetable fats and oils as being useful in overbasing operations.

McMillen in U.S. Pat. No. 3,242,079 issued Mar. 22, 1966 describes obtaining homogeneous grease compositions characterized by high basicity. The compositions of McMillen are also stated to be useful in lubricants, additives for lubricants, asphalts, fuels, coating oils, caulking compositions and the like. McMillen states that he obtains a fluid mineral oil solution which contains from about 10 to about 70% of a carbonated, basically alkaline earth metal salt of an acid having at least 12 aliphatic carbon atoms and which is either a sulfonic acid or a carboxylic acid through the use of a lower aliphatic carboxylic acid, water, or a water-alcohol mixture at conditions between 25° C. and the reflux temperature of the mixture.

U.S. Pat. No. 3,372,114 issued Mar. 5, 1968 to Rense describes the production of gelled materials useful as lubricant additives in greases prepared by contacting a fluid mineral oil solution of a carbonated, basic complex of an alkaline earth metal and an organic carboxylic or sulfonic acid, salt thereof, or carboxylic ester containing at least 12 aliphatic carbon atoms. Rense further states that his complex is characterized by having a metal ratio of at least 4.5 and that an essential step in the processing is contacting the aforementioned mixture with oxygen at a temperature of about 150° C. to about 300° C.

McMillen in U.S. Pat. No. 3,377,283 describes a continuous operation for obtaining an alkali or alkaline earth metal overbased organic material by effecting the conversion in an elongated heating tube at from 90° C. to 320° C. Water, carboxylic acids and alcohols are stated to be suitable conversion agents by McMillen.

Scher in U.S. Pat. No. 3,422,013 issued Jan. 14, 1969 describes a process for the preparation of non-Newtonian colloidal dispersed systems obtained by the treatment of carbonated, highly basic calcium sulfonate with water. Various alcohols or phenols, mercaptans, amines or acid-nitro compounds, metal phenates or enolic compounds may be utilized to promote the overbasing reactions.

Corringer U.S. Pat. No. 3,671,430 discloses using alkylphenols or alkylphenol sulfides in an overbasing process. The Corringer patent which issued June 20, 1972 specifically discloses calcium hydroxide as the source of the alkaline earth metal. Siga et al in U.S. Pat. No. 4,057,504 issued Nov. 8, 1977 discusses the use of dihydric alcohols, phenols and elemental sulfur in obtaining an overbased compound. U.S. Pat. No.2,761,845 issued Sept. 4, 1956 to Rogers et al describes the use of phenol sulfides in lubricant compositions.

It has been observed in the present invention that the later described method for overbasing magnesium compounds provides superior results in performance and in end use compositions.

Throughout the specification and claims percentages and ratios are by weight, temperatures are Celsius and pressures are in KPa gauge unless otherwise indicated. All ranges used herein are exemplary and may be combined. To the extent that any of the references cited in this application are pertinent to the present invention, they are herein incorporated by reference.

SUMMARY OF THE INVENTION

The invention describes a process for overbasing a substrate comprising mixing the substrate, water, a phenol, a source of magnesium and a carbonating agent, wherein the water is retained throughout the overbasing reaction and provided further that the weight ratio of the water to the magnesium is in a 10:1 to 1:5 weight ratio, thereby obtaining a magnesium overbased substrate.

The present invention also describes the product of the above process, a concentrate of the product with a diluent and the product plus a major amount of an oil of lubricating viscosity.

DETAILED DESCRIPTION OF THE INVENTION

The first component of the present invention is the substrate which is overbased. The substrate may also be referred to as an organic acid which when typically prepared is hydrocarbon-soluble or hydrocarbon-dispersible.

A. THE SUBSTRATE

Organic acids susceptible to overbasing, that is, those which can be converted to basic magnesium salts according to the present invention include those known organic acids which have been used or are presently used in preparing basic alkaline earth metal salts (e.g., those described in U.S. Pat. Nos. 3,312,618; 2,695,910; and 2,616,904) and constitute an art-recognized class of acids. These organic acids are generally oil-soluble acids but oil-insoluble organic acids can be used in the present process provided basic magnesium salts prepared therefrom according to the procedures of the present invention are soluble in oils (including fuels, fuel oils) at a concentration at which the basic magnesium salt imparts desirable properties thereto as described herein. Thus, in the present specification organic acids can be considered "oil-soluble" if they or their normal or basic metal salts are oil-soluble. The phosphorus acids, carboxylic acids, and sulfur acids, which are oil-soluble per se, particularly the oil-soluble sulfonic acids are especially useful. Oil-soluble derivatives of these organic acids susceptible to overbasing such as their metal salts (e.g., Group I and Group II neutral and basic metal salts) ammonium salts, and esters (particularly esters with lower aliphatic alcohols having up to six carbon atoms such as the lower alkanols), can be utilized in the present processes in lieu of, or in combination with the free acids. The alkali metal-salts can, if desired, be converted in situ to the magnesium salt, or from another alkaline earth metal salt by double decomposition techniques. When reference is made to the acid, its equivalent derivatives susceptible to overbasing are implicitly included unless it is clear that only the acid is intended. Preferably, an oil-soluble organic acid or its oil-soluble neutral or basic alkali or alkaline earth metal salts, including magnesium salts, or mixtures of these will be employed as the oil-soluble organic acid reactant in the process of this invention.

The phosphorus-containing acids are characterized by at least one oil-solubilizing group attached directly to phosphorus via a carbon atom, e.g., oil-soluble phosphinic and phosphonic acids including the oil-soluble thiophosphinic and thiophosphonic acids. Preferred phosphorus acids are those prepared by reacting olefins with phosphorus sulfides (e.g., phosphorus pentasulfide). Steam-treated reaction products of phosphorus pentasulfide and polyolefins such as polyisobutylene and polypropylene shown by U.S. Pat. Nos. 2,316,078; 2,316,080; 2,316,091; 2,367,468; 2,375,315; 2,377,955; 2,496,508; 2,507,731; 2,516,119; 2,597,750; 2,647,889; 2,688,612 and 2,195,517 which describe the preparation of metal salts of the acids and the preparation of the acid intermediates.

Suitable carboxylic acids include aliphatic cycloaliphatic and aromatic mono and polybasic carboxylic acids such as the naphthenic acids, alkyl- or alkenylsubstituted cyclopentanoic acids, alkyl- or alkenylsubstituted cyclohexanoic acids, alkyl- or alkenylsubstituted aromatic carboxylic acids. The aliphatic acids generally contain at least eight carbon atoms and preferably at least twelve carbon atoms. Generally, if the aliphatic carbon chain is branched, the acids are more oil-soluble for any given carbon atom content. The cycloaliphatic and aliphatic carboxylic acids can be saturated or unsaturated. Specific examples include 2-ethylhexanoic acid, linolenic acid, propylene-tetramersubstituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyloctahydroindene carboxylic acid, palmitic acid, commercially available mixtures of two or more carboxylic acids such as tall oil acids, rosin acids, and the like.

A preferred group of oil-soluble carboxylic acids useful in preparing the basic magnesium salts of the present invention are the oil-soluble aromatic carboxylic acids. These acids are represented by the general formula:

$$(R)_n(Ar)(CXXH)_m \qquad \text{I}$$

where R is a hydrocarbon or essentially hydrocarbon radical containing at least four aliphatic carbon atoms, n is an integer of from one to four, Ar is a polyvalent aromatic hydrocarbon radical having a total of up to fourteen carbon atoms in the aromatic nucleus, each X is independently a divalent sulfur or oxygen group, and m is an integer of from one to four with the proviso that R and n are such that there is an average of at least eight aliphatic carbon atoms provided by the R substituents for each acid molecule represented by Formula I. Examples of aromatic radicals represented by the variable Ar are the polyvalent aromatic radicals derived from benzene, naphthalene, anthracene, phenanthrene, indene, fluorene, biphenyl, and the like. Generally, the radical represented by Ar will be a polyvalent radical derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent radicals thereof, etc.

The R variables are usually hydrocarbon groups, preferably aliphatic hydrocarbon groups such as alkyl or alkenyl radicals. However, the R groups can contain such substituents as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e.,=O), thio groups (i.e.,=S), interrupting groups such as —NH—, —O—, —S—, and the like provided the essentially hydrocarbon character of the R variable is retained. The hydrocarbon character is retained for purposes of this invention so long as any non-carbon atoms present in the R variables do not account for more than about 10% of the total weight of the R variables. Examples of R groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise the variable Ar may contain nonhydrocarbon substituents, for example, such diverse substituents as lower alkoxy, lower alkyl mercapto, nitro, halo, alkyl or alkenyl groups of less than four carbon atoms, hydroxy, mercapto and the like.

A group of more preferred oil-soluble carboxylic acids are those of the formula:

$$(R)_n(Ar)(XH)_p(CXXH)_m \quad \text{II}$$

where R, X, Ar, m and n are as defined in Formula I and p is an integer of 1 to 4, usually 1 or 2. Within this group, an especially preferred class of oil-soluble carboxylic acids are those of the form:

$$(R')_aPh(OH)_c(COOH)_b \quad \text{III}$$

where Ph is a phenyl group, R' is an aliphatic hydrocarbon radical containing at least four carbon atoms, a is an integer of from 1 to 3, b is 1 or 2, c is zero, 1, or 2 and preferably 1 with the proviso that R' and a are such that the acid molecules contain at least an average of about twelve aliphatic carbon atoms in the aliphatic hydrocarbon substituents per acid molecule. And, within this latter group of oil-soluble carboxylic acids, the aliphatic-hydrocarbon substituted salicylic acids wherein each aliphatic hydrocarbon substituent contains an average of at least about sixteen carbon atoms per substituent and one to three substituents per molecule are particularly useful. Basic magnesium salts prepared from such salicylic acids wherein the aliphatic hydrocarbon substituents are derived from polymerized olefins, particularly polymerized lower 1-mono-olefins such as polyethylene, polypropylene, polyisobutylene, ethylenepolypropylene copolymers and the like and having an average molecular weight of about 200 to about 1200, preferably about 300 to about 700, are very useful as lubricant additives. The oil-soluble carboxylic acids corresponding to Formulae I–III above are well-known or can be prepared according to procedures known in the art.

The most preferred oil-soluble organic acids for use in preparing the basic magnesium salts are the oil-soluble sulfonic acids including the synthetic oil-soluble sulfonic acids. Suitable oil-soluble acids are represented by the general formulae:

$$R_x—T—(SO_3H)_y \quad \text{IV}$$

$$R'\text{-}(SO_3H)_r \quad \text{V}$$

In Formula IV, T is a cyclic nucleus of the mono- or poly-nuclear type including benzenoid or heterocyclic nuclei such as a benzene, naphthalene, anthracene, 1,2,3,4-tetrahydronaphthalene, thianthrene, or biphenylnucleus and the like. Ordinarily, however, T will represent an aromatic hydrocarbon nucleus, especially a benzene or naphthalene nucleus. The variable R in the radical $R_x$ includes the same groups as the R variable in Formula I above and can be, for example, an aliphatic group such as alkyl, alkenyl, alkoxy, alkoxyalkyl, carboalkoxyalkyl, an aralkyl group, or other hydrocarbon or essentially hydrocarbon groups, while x is at least one with the proviso that the variables represented by the group $R_x$ are such that the acids are oil-soluble. This means that the groups represented by $R_x$ should contain at least about eight aliphatic carbon atoms per sulfonic acid molecule and preferably at least about twelve aliphatic carbon atoms. Conveniently, the value of R or R* is from about 16 to about 40 carbon atoms. Generally x will be an integer of 1–3. The variables r and y have an average value of one to about four per molecule.

The variable R' in Formula V is an aliphatic or aliphatic-substituted cycloaliphatic hydrocarbon or essentially hydrocarbon radical. Where R' is an aliphatic radical, it should contain at least about fifteen to about eighteen carbon atoms and where R' is an aliphatic substituted-cycloaliphatic group, the aliphatic substituents should contain a total of at least about twelve carbon atoms. Examples of R' are alkyl, alkenyl, and alkoxyalkyl radicals and aliphatic-substituted cycloaliphatic radicals wherein the aliphatic substituents are alkoxy, alkoxy-alkyl, carboalkoxyalkyl, etc. Generally the cycloaliphatic radical will be a cycloalkane nucleus or a cycloalkene nucleus such as cyclopentane, cyclohexane, cyclohexene, cyclopentene, and the like. Specific examples of R' are cetyl-cyclohexyl, laurylcyclohexyl, cetyl-oxyethyl and octadecenyl radicals, and radicals derived from petroleum, saturated and unsaturated paraffin wax, and polyolefins, including polymerized mono- and diolefins containing from about 1 to 8 carbon atoms per olefin monomer unit. The groups T, R and R' in Formulae IV and V can also contain other substituents such as hydroxy, mercapto, halogen, nitro, amino, nitroso, carboxy, lower carbo-alkoxy, etc., as long as the essentially hydrocarbon character of the groups is not destroyed.

Illustrative examples of the sulfonic acids are mahogany sulfonic acids, petrolatum sulfonic acids, monoand polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, di-lauryl beta-naphthol sulfonic acids, dicapryl nitronaphthylene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax, nitrosyl-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, and the like.

As used herein, the terminology "petroleum sulfonic acids" or "petrosulfonic acids" is intended to cover that well-known class of sulfonic acids derived from petroleum products according to conventional processes such as disclosed in U.S. Pat. Nos. 2,480,638; 2,483,800; 2,717,265; 2,726,829; 2,832,801; 3,225,086; 3,337,613; 3,351,655 and the like. Sulfonic acids falling within Formulae IV and V are discussed in prior U.S. Pat. Nos. as 2,616,904; 2,616,905; 2,723,235; 2,723,236; 2,777,874 and the other U.S. patents referred to in each of these patents. Thus, it is seen that these oil-soluble sulfonic acids are well-known in the art and require no further discussion herein.

Of course, mixtures of the above-described organic acids and derivatives thereof susceptible to overbasing can be employed in the processes of this invention to prepare basic magnesium salts. In fact, as described below, some mixtures of acids constitute preferred embodiments of the invention.

A further substrate which may be employed in the present invention is an alkyl phenol. Typically, the alkyl phenol or a compound derived from an alkyl phenol, having at least 5 to 30 carbon atoms and preferably from 6 to 17 carbon atoms in the alkyl portion is usable as a substrate. It is also possible for the alkyl phenol to be a sulfide or methylene linked alkyl phenol. The sulfur linked materials are obtained by treating an alkyl phenol with sulfur dichloride or elemental sulfur. The alkaline earth salt can be obtained by causing an alkaline earth base to react on the alkyl phenol sulfide. Such alkyl phenols or alkyl phenol sulfides include hexylphenol, nonylphenol, dodecylphenol, hexadecylphenol, the sulfides of any of the phenols, and the alkaline earth metal salts of any of the phenols or their sulfides. The methylene linked phenols are obtained through the use of formaldehyde which condenses between the phenolic rings to give a methylene coupled product.

The following are succinic acids are useful as a substrate including neutral and basic carboxylate salts derived from alkenyl succinates of the general formula:

$$R^*CH(COOH)CH_2COOH \qquad VI$$

wherein R* is as defined above in Formula I. Such salts and means for making them are set forth in U.S. Pat. Nos. 3,271,130 and 3,567,637.

A further species useful herein are the disuccinates of the formula:

$$R^*[CH(COOH)CH_2COOH]_2 \qquad VII$$

which may be obtained from Meinhardt, U.S. Pat. No. 4,234,435 issued Nov. 18, 1980.

Generally, the molecular weight of the polybasic carboxylates will be about 400 to 2,000, preferably about 500 to 1500 for the anionic portion of the molecule. Such molecular weights will correspond to about 28 to about 145 carbon atoms, preferably about 35 to about 100 carbon atoms in the hydrocarbyl portion of the anion.

Other patents specifically describing techniques for making basic salts of the hereinabove-described carboxylic acids include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790 and 3,629,109.

Thus, specific substrates within the scope of the present invention include salicyclic acids, carboxylic acids, sulfonic acids, succinic acids or an alkyl phenol or a sulfur or methylene linked alkyl phenol.

B. THE WATER

Water is an essential ingredient in the present invention and it is required in order to obtain the superior overbased products of the present invention that the water be in a weight ratio to the magnesium as later described at from about 10:1 to about 1:5, preferably about 8:1 to about 1:4, most preferably from about 6:1 to about 1:3.

C. THE PHENOL

The phenol as described herein is one or more aromatic rings joined together and containing at least one free hydroxyl group. Preferably, the phenol is monocyclic, e.g., a benzene ring. It is further preferred that the phenol be the simplest member of the group of phenols, e.g., phenol per se. It is, however, possible for phenols to be employed in the present invention to contain short aliphatic chains typically of one to three carbon atoms. The carbon atoms may be in a single aliphatic chain or may be distributed around the phenyl ring structure. Halogenated phenols or other phenols containing non-interferring substituents may be used herein. Examples of such materials are cresol, cumenol and chlorophenol.

It is noted herein that the amount of phenol employed in the present invention is typically less than that which would be required to convert substantially all of the magnesium to magnesium phenate if that reaction is conducted. In any event, the phenol is substantially removed from the reaction mixture following the overbasing, and, except for minor quantities which may be converted to the phenate, is completely removed from the finished product. The removal of the phenol is accomplished by distillation. For this reason, phenol, per se, is the desired material utilized at this aspect of the invention.

The purpose of employing the phenol is as a promoter. The function of a promoter is to enhance the contact of the organic and inorganic phases of the reaction mixture so that a substantially homogeneous product is obtained.

It is particularly preferred in the present invention that the phenol and water be the sole promoter system utilized in the present invention. Materials which have been typically utilized as copromoters and which should be substantially absent in the process include ammonia, alkanolamines, lower carboxylic acids or salts thereof and polyamines. It is particularly preferred that the process of the present invention be conducted in the substantial absence of aliphatic alcohols, particularly lower aliphatic alcohols, such as methanol or ethanol. It is further preferred, in line with the above, that lower carboxylic acids not be present in the present invention, specifically excluding acetic acid in the reaction mixture. When acetic acid, for instance, is utilized in the reaction mixture, a substantial amount of that material will be converted to the corresponding acetate salt which will remain with the organic phase of the product when the water and any other volatile materials are eventually distilled off.

It is also noted, at this point, that when an alkylated phenol is employed as the substrate in the present invention that the equivalent ratio (based on the hydroxyl) to phenol as a promoter is from about 30:1 to about 2:1; preferably about 20:1 to about 4:1 on an equivalent basis. That is, the equivalent basis of the phenol to the alkylated phenol is determined by the number of free hydroxyl groups on the starting phenol and the alkyl phenol.

D. THE SOURCE OF MAGNESIUM

The principal source of magnesium in the processes of the present invention is active magnesium oxide. Magnesium oxide is commercially available in two forms, a so-called "light" or "active" form and a relatively inactive form known as "dead burned" or "heavy" magnesium oxide. Active forms of magnesium oxide are available from various chemical companies under such names as Magox 98HR from Basic Chemicals Inc. and Magchem 40 from Martin-Marietta. The use of magnesium oxide in lieu of magnesium metal avoids the problems associated with the storage, handling and reactions of magnesium metal offers a tremendous economic advantage.

The source of magnesium is preferably employed in a phenol to magnesium weight ratio of 3:4 to 1:10, preferably 1:1 to 1:7.

E. THE CARBONATING AGENT

The carbonating agent utilized in the present invention is conveniently any source of carbon dioxide whether utilizing the gas, solid or an in situ generated form of carbon dioxide which does not otherwise interfere with obtaining an oil-soluble or oil-dispersible magnesium overbased substrate. Conveniently, the carbon dioxide is contacted with the components of the reaction mixture until no further reaction between the components of the reaction mixture and the carbon dioxide is obtained. That is, the reaction is continued between the components until the reaction substantially ceases. This may be determined in a number of ways conventionally described in the art. For example, if the carbon dioxide is bubbled through the reaction mixture then an "endpoint" is reached when the amount of gas being blown into the mixture substantially equals (that is, corresponds to about 90%-100%) of the equals amount of gas leaving the reaction mixture This is readily determined by the use of a metered inlet and outlet valve for the gas. While is it preferable that the acidic material be contacted with the reaction mixture until there is no further reaction, useful basic magnesium salts can be prepared when the reaction mixture is contacted with the carbon dioxide for a period of time sufficient for about 70% by weight of the total carbon dioxide to react relevant to the amount which would react if the reaction were permitted to proceed to its "endpoint".

THE PROCESS

To practice the present invention, the following steps are conveniently followed. A suitable reaction vessel which is conveniently glass lined or stainless steel of a suitable size is obtained. A diluent oil and/or solvent in a suitable amount is introduced to the reaction vessel. The diluent oil is conveniently any variety of mineral oil of suitable grade for an overbasing reaction. The solvent is typically a lower hydrocarbon material such as pentane, hexane, cyclohexane, heptane, benzene, xylene or toluene which is relatively easily distilled from the reaction mixture following the overbasing reaction. Also conveniently included herein is a small amount of a polyisobutenyl succinic acid anhydride.

A suitable amount of the source of magnesium typically as magnesium oxide as previously discussed and the phenol are added and the mixture of the above ingredients is thoroughly stirred.

The reaction mixture is typically heated and stirred at about 110° C.-170° C., preferably 120° C.-160° C. to ensure homogeneity of the mixture. The reaction mixture is then typically combined with the solvent, the substrate, and the water. This mixture is typically stirred for about 5 minutes to about 2 hours to substantially disperse the ingredients with one another.

The carbonating agent is then typically introduced at a rate averaging from about 0.1 cubic foot per hour (0.25 equivalents) to about 25 cubic feet per hour (62.5 equivalents). The reaction vessel is cooled to maintain the temperature at less than about 90° C., preferably from about 25° C. to about 79° C. The introduction of the gaseous carbon dioxide is continued as previously discussed for a period of about 2 to about 10 hours.

The carbon dioxide flow is then typically continued while the charge is stripped of excess solvent, water and phenol. A further variation of the present invention is to add a lower boiling aromatic solvent such as toluene or xylene after a substantial amount of the aliphatic solvent has been removed. The two stripping temperatures previously discussed are respectively from about 50° C. to about 150° C. and about 80° C. to about 190° C. Following the first and second stripping reaction, the product is vacuum stripped at about 20 mm Hg (2.7 KPa) at a temperature of about 130° C. to about 180° C.

When filtering is employed a filter aid such as diatomaceous earth may be utilized herein typically at from about 1 to about 20% by weight of the total charge of the product.

The stripped product may then be typically combined with additional quantities of mineral oil or other suitable diluent and utilized to form a concentrate of the product. The products of the present invention may be conveniently combined into an oil product either indirectly through the use of the diluent or directly by preparing the composition with a suitable amount of an oil of lubricating viscosity.

The oil of lubricating viscosity which is utilized in the preparation of the diesel lubricants of the invention may be based on natural oils, synthetic oils, or mixtures thereof. Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinicnaphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the $C_{13}$ oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butyl-phenyl)silicate, hexyl-(4-methyl- 2-pentoxy)disiloxane, poly(methyl)siloxans, poly(methylphenyl)siloxanes, etc.). Other synthetic lubricating oils include liquid esters of phosphorus-containing acids (e.g., tricresyl phosphate, trioxtyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil.

Refined oils are similar to the unrefined oils except they have been further treated in one or more purification steps to improve one or more properties. Many such purification techniques are known to those skilled in the art such as solvent extraction, secondary distillation, hydrotreating, hydrocracking, acid or base extraction, filtration, percolation, etc.

Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

Typically, the major amount of the oil of lubricating viscosity to the magnesium overbased composition of the present invention is such that the amount of magnesium in the overall product is present at about 0.05 parts to about 15 parts, preferably about 0.2 parts to 3 parts per 1,000 parts of the lubricating oil products.

Additional useful ingredients which may be employed with a fully formulated oil containing the magnesium overbased substrate of the present invention are the following. These materials may be either combined into the oil with the magnesium overbased substrate or may be precombined with one or more ingredients such as the product of the present invention. A useful additional ingredient herein is a phenol which is halogenated, or sulfur or formaldehyde coupled additional materials include, for example, detergents and dispersants of the ash-producing or ashless type.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at at a temperature about 50° C. and filtering the resulting mass.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of carboxylic acids (or derivatives thereof) containing at least about 30 and preferably at least about 50 carbon atoms with nitrogen containing compounds such as amine, organic hydroxy compounds such as phenols and alcohols, and/or basic inorganic materials. Examples of these "carboxylic dispersants" are described in British Patent 1,306,529 and in many U.S. Pat. Nos. including the following:

| PATENT | INVENTOR | ISSUE DATE |
|---|---|---|
| 3,163,603 | Le Suer | December 29, 1964 |
| 3,184,474 | Catto | May 18, 1965 |
| 3,215,707 | Rense | November 2, 1965 |
| 3,219,666 | Norman et al | November 23, 1965 |
| 3,271,310 | Le Suer | September 6, 1966 |
| 3,272,746 | Le Suer et al | September 13, 1966 |
| 3,281,357 | Vogel | October 25, 1966 |
| 3,306,908 | Le Suer | February 28, 1967 |
| 3,311,558 | Prizer et al | March 28, 1967 |
| 3,316,177 | Dorer | April 25, 1967 |
| 3,340,281 | Brannen | September 5, 1967 |
| 3,341,542 | Le Suer et al | September 12, 1967 |
| 3,346,493 | Le Suer | October 10, 1967 |
| 3,351,552 | Le Suer | November 7, 1967 |
| 3,381,022 | Le Suer | April 30, 1968 |
| 3,399,141 | Clemens | August 27, 1968 |
| 3,415,750 | Anzenberger | December 10, 1968 |
| 3,433,744 | Le Suer | March 18, 1969 |
| 3,444,170 | Norman et al | May 13, 1969 |
| 3,448,048 | Le Suer | June 3, 1969 |
| 3,448,049 | Preuss et al | June 3, 1969 |
| 3,451,933 | Leister | June 24, 1969 |
| 3,454,607 | Le Suer | July 8, 1969 |
| 3,467,668 | Gruber et al | September 16, 1969 |
| 3,501,405 | Willette | March 17, 1970 |
| 3,522,179 | Le Suer | July 28, 1970 |
| 3,541,012 | Stuebe | November 17, 1970 |
| 3,542,680 | Le Suer | November 24, 1970 |
| 3,543,678 | Hobbs | December 1, 1970 |

-continued

| PATENT | INVENTOR | ISSUE DATE |
|---|---|---|
| 3,567,637 | Sabol | March 2, 1971 |
| 3,574,101 | Murphy | April 6, 1971 |
| 3,576,743 | Widmer et al | April 27, 1971 |
| 3,630,904 | Musser et al | December 28, 1971 |
| 3,632,510 | Le Suer | January 4, 1972 |
| 3,632,511 | Chien-Wei Liao | January 4, 1972 |
| 3,697,428 | Meinhardt | October 10, 1972 |
| 3,725,441 | Murphy | April 3, 1973 |
| 4,234,435 | Meinhardt | November 18, 1980 |
| Re 26,433 | Le Suer | August 6, 1968 |

(2) Reaction products of relatively high molecular weight aliphatic or alicyclic halides with amines, preferably polyalkylene polyamines. These may be characterized as "amine dispersants" and examples thereof are described for example, in the following U.S. Pat. Nos.

| PATENT | INVENTOR | ISSUE DATE |
|---|---|---|
| 3,275,554 | Wagenaar et al | September 27, 1966 |
| 3,438,757 | Honnen et al | April 15, 1969 |
| 3,454,555 | vander Voort et al | July 8, 1969 |
| 3,565,804 | Honnen et al | February 23, 1971 |

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. Pat. Nos. are illustrative:

| PATENT | INVENTOR | ISSUE DATE |
|---|---|---|
| 2,459,112 | Oberright | January 11, 1949 |
| 2,962,442 | Andress | November 29, 1960 |
| 2,984,550 | Chamot | May 16, 1961 |
| 3,036,003 | Verdol | May 27, 1962 |
| 3,166,516 | Kirkpatrick et al | January 19, 1965 |
| 3,236,770 | Matson | February 22, 1966 |
| 3,355,270 | Amick | November 28, 1967 |
| 3,368,972 | Otto | February 13, 1968 |
| 3,413,347 | Worrel | November 26, 1968 |
| 3,442,808 | Traise | May 6, 1969 |
| 3,448,047 | Traise | June 3, 1969 |
| 3,454,497 | Wittner | July 8, 1969 |
| 3,459,661 | Schlobohm | August 5, 1969 |
| 3,461,172 | Previc | August 12, 1969 |
| 3,493,520 | Verdol et al | February 3, 1970 |
| 3,539,633 | Piasek et al | November 10, 1970 |
| 3,558,743 | Verdol et al | January 26, 1971 |
| 3,586,629 | Otto et al | June 22, 1971 |
| 3,591,598 | Traise et al | July 6, 1971 |
| 3,600,372 | Udelhofen et al | August 17, 1971 |
| 3,634,515 | Piasek et al | January 11, 1972 |
| 3,649,229 | Otto | March 14, 1972 |
| 3,697,574 | Piasek et al | October 10, 1972 |
| 3,725,277 | Worrel | April 3, 1973 |
| 3,725,480 | Traise et al | April 3, 1973 |
| 3,726,882 | Traise et al | April 10, 1973 |
| 3,980,569 | Pindar et al | September 14, 1976 |

(4) Products obtained by post-treating the carboxylic, amine or Mannich dispersants with such reagents as urea, thourea, carbon disulfice, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos:

| PATENT | INVENTOR | ISSUE DATE |
|---|---|---|
| 3,036,003 | Verdol | May 22, 1962 |
| 3,087,936 | Le Suer | April 30, 1963 |
| 3,200,107 | Le Suer | August 10, 1965 |
| 3,216,936 | Le Suer | November 9, 1965 |
| 3,254,025 | Le Suer | May 31, 1966 |
| 3,256,185 | Le Suer | June 14, 1966 |
| 3,278,550 | Norman et al | October 11, 1966 |
| 3,280,234 | Osborn | October 18, 1966 |
| 3,281,428 | Le Suer | October 25, 1966 |
| 3,282,955 | Le Suer | November 1, 1966 |
| 3,312,619 | Dale | April 4, 1967 |
| 3,366,569 | Norman et al | January 30, 1968 |
| 3,367,943 | Miller et al | February 6, 1968 |
| 3,373,111 | Le Suer et al | March 12, 1968 |
| 3,403,102 | Le Suer | September 24, 1968 |
| 3,442,808 | Traise et al | May 6, 1969 |
| 3,455,831 | Davis | July 15, 1969 |
| 3,455,832 | Davis | July 15, 1969 |
| 3,493,520 | Verdol et al | February 3, 1970 |
| 3,502,677 | Le Suer | March 24, 1970 |
| 3,513,093 | Le Suer | May 19, 1970 |
| 3,533,945 | Vogel | October 13, 1970 |
| 3,539,633 | Piasek et al | November 10, 1970 |
| 3,573,010 | Mehmedbasich | March 30, 1971 |
| 3,579,450 | Le Suer | May 18, 1971 |
| 3,591,598 | Traise | July 6, 1971 |
| 3,600,372 | Udelhofen | August 17, 1971 |
| 3,639,242 | Le Suer | February 1, 1972 |
| 3,649,229 | Otto | March 14, 1972 |
| 3,649,659 | Otto et al | March 14, 1972 |
| 3,658,836 | Vineyard | April 25, 1972 |
| 3,697,574 | Piasek et al | October 10, 1972 |
| 3,702,757 | Mehmedbasich et al | November 14, 1972 |
| 3,703,536 | Piasek et al | November 21, 1972 |
| 3,704,308 | Piasek et al | November 28, 1972 |
| 3,708,422 | Swanson | January 2, 1973 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.:

| PATENT | INVENTOR | ISSUE DATE |
|---|---|---|
| 3,329,658 | Fields | July 4, 1967 |
| 3,449,250 | Fields | June 10, 1969 |
| 3,519,565 | Coleman | July 7, 1970 |
| 3,666,730 | Coleman | May 30, 1972 |
| 3,687,849 | Abbott | August 29, 1972 |
| 3,702,300 | Coleman | November 7, 1972 |

As previously mentioned, the compositions of the present invention are useful as additives for lubricants. Generally, these lubricant compositions comprise a major amount of an oil of lubricating viscosity and a minor amount of the manganese or other metallic compound of the present invention.

The term "minor amount" are used in the specification and appended claims is intended to mean that when a composition contains a "minor amount" of a specific material that amount is less than about 50% by weight of the composition.

The term "major amount" is used in the specification and appended claims is intended to mean that when a composition contains a "major amount" of a specific material that amount is more than 50% by weight of the composition. In relation to one another, a major amount of one component means that component is present in a greater amount than the component which is present in a minor amount.

The following are examples of the present invention.

EXAMPLE I

A phenol overbased alkyl sulfonic acid is obtained substantially as described herein.

A 4-necked glass flask is equipped with a stirrer, thermowell, reflux condenser and subsurface sparger tube. The reaction flask is charged with 362 grams of mineral oil, 48 grams of a polyisobutenyl succinic anhydride having an equivalent weight of about 450, 155 grams of magnesium oxide and 188 grams of phenol.

The reaction mixture is stirred and the charge is heated to 142° C. for one hour and then cooled. Following the cooling, 775 grams of hexane solvent is added as well as 280 grams of a alkylbenzene sulfonic acid mixture having an approximate molecular weight of 420 and corresponding to a total of 24 aliphatic carbon atoms in the aliphatic chain. To this mixture is further added 155 grams of water and stirring is initiated for a period of ½ hour following addition of all of the ingredients.

The carbonating agent ($CO_2$) is then begun below the surface at the rate of 0.5 cubic feet/per hour (1.25 eq.). The reaction mixture is cooled to maintain the temperature at about 35° C. The carbon dioxide is continued at the rate given above for about 5.25 hours. Carbon dioxide flow is continued at 0.5 cubic feet per hour (1.25 eq.) and the charge is then stripped. At approximately 70° C., after about 400 milliliters of hexane have been removed, there is added to the reaction mixture 310 grams of xylene and the stripping is continued at 154° C. The xylene is added to prevent gel formation of the product in contact with the water in the regions of high splash. If the stirring motion is slow with little or no splash until the water is removed, the xylene is not necessary. Alternatively, flash stripping may solve the problem of water gelation of the product.

The last aspect of the present invention is the vacuum stripping of the charge at 163° C. at 20 mm mercury (2.7 KPa). The product is held at the foregoing temperature and pressure for one hour. Thereafter, 48 grams of DD-1600 filter aid (5% by weight of the charge) is added and the mixture is filtered. The filtrate is recovered as the product having a yield of 870 grams.

The above product is useful as a concentrate.

What is claimed is:

1. A process for overbasing a substrate comprising mixing a composition comprising said substrate, water, a phenol containing up to 3 aliphatic carbon atoms, a source of magnesium and a carbonating agent, under reaction conditions to form a magnesium overbased substrate, said water being substantially retained in said composition throughout the overbasing reaction, the weight ratio of water to magnesium being about 10:1 to about 1:5.

2. The process of claim 1 wherein said substrate is selected from the group consisting of at least one salicylic acid, carboxylic acid, sulfonic acid, succinic acid or alkyl phenol.

3. The process of claim 1 wherein said composition is characterized by the substantial absence of a copromoter.

4. The process of claim 1 wherein said substrate is a substituted aromatic sulfonic acid.

5. The process of claim 1 wherein said phenol comprises phenol per se.

6. The process of claim 1 wherein said substrate comprises an alkyl aromatic sulfonic acid.

7. The process of claim 1 wherein said phenol is substantially separated from said magnesium overbased substrate.

8. The process of claim 1 wherein said carbonating agent comprises carbon dioxide and the temperature of said composition is maintained at less than about 90° C. during said process.

9. The process of claim 1 wherein said substrate comprises at least one alkyl-substituted aromatic sulfonic acid containing from about 16 to about 40 carbon atoms in the alkyl portion.

10. The process of claim 1 wherein said composition is maintained at a temperature in the range of about 25° C. to about 79° C. during said process.

11. The process of claim 1 wherein said composition further comprises at least one hydrocarbon solvent.

12. The process of claim 1 which wherein said composition is free of ammonia, alkanolamines, lower carboxylic acids or salts thereof, and polyamines.

13. The process of claim 1 wherein the metal ratio of said magnesium to said substrate is about 10:1 to about 30:1.

14. The process of claim 1 wherein said composition is characterized by the substantial absence of an aliphatic alcohol.

15. The process of claim 1 wherein said source of magnesium is magnesium oxide.

16. The process of claim 1 wherein said substrate comprises at least one alkyl phenol.

17. The process of claim 1 wherein the weight ratio of said phenol to said magnesium is about 3:4 to about 1:10.

18. The process of claim 1 wherein the amount of phenol in said composition is less than the amount that is sufficient to convert substantially all of the magnesium in said composition to magnesium phenate.

19. The process of claim 1 wherein said phenol contains from 1 to 3 aliphatic carbon atoms.

20. The process of claim 1 wherein said composition further comprises at least one phenol which is halogenated, or at least one phenol which is sulfur or formaldehyde coupled.

21. The process of claim 1 wherein said composition further comprises at least one hydrocarbon solvent, said hydrocarbon solvent being selected from the group consisting of pentane, hexane, heptane and mixtures thereof.

22. The process of claim 1 wherein said substrate comprises at least one alkylated phenol, the equivalent ratio of said phenol to said alkylated phenol being about 30:1 to about 2:1.

* * * * *